US008128451B2

(12) United States Patent
Frontera Castaner et al.

(10) Patent No.: US 8,128,451 B2
(45) Date of Patent: Mar. 6, 2012

(54) METHOD AND APPARATUS FOR WING MOUNTING FOR A MODEL AIRPLANE

(75) Inventors: Miguel A. Frontera Castaner, St. Joseph, IL (US); Keh-Bing Sheng, Savoy, IL (US)

(73) Assignee: Hobbico, Inc., Champaign, IL (US)

( * ) Notice: Subject to any disclaimer, the term of this patent is extended or adjusted under 35 U.S.C. 154(b) by 129 days.

(21) Appl. No.: 12/620,081

(22) Filed: Nov. 17, 2009

(65) Prior Publication Data

US 2011/0117806 A1 May 19, 2011

(51) Int. Cl.
*A63H 27/00* (2006.01)

(52) U.S. Cl. ..... 446/34; 446/61; 446/66

(58) Field of Classification Search ..... 446/34, 446/61, 66

See application file for complete search history.

(56) References Cited

U.S. PATENT DOCUMENTS

| | | | | |
|---|---|---|---|---|
| 2,791,867 | A | 5/1957 | Dasher | |
| 2,932,124 | A * | 4/1960 | Robinette | 446/61 |
| 3,640,491 | A | 2/1972 | Harrison | |
| 3,735,524 | A * | 5/1973 | Staats et al. | 446/34 |
| 3,935,664 | A | 2/1976 | Neuhierl | |
| 4,698,041 | A * | 10/1987 | Dasa | 446/61 |
| 4,915,665 | A * | 4/1990 | Ming | 446/34 |
| 5,853,312 | A * | 12/1998 | Li | 446/61 |
| 6,224,451 | B1 * | 5/2001 | Lai | 446/34 |
| 6,425,794 | B1 | 7/2002 | Levy et al. | |
| 6,938,856 | B2 | 9/2005 | Frontera Castaner | |
| 6,986,695 | B2 | 1/2006 | Frontera Castaner | |
| 7,182,666 | B2 | 2/2007 | Frontera Castaner | |
| 2005/0252006 | A1 | 11/2005 | Lopez | |
| 2005/0252066 | A1 * | 11/2005 | Couvillion, III | 43/3 |
| 2008/0217470 | A1 | 9/2008 | Zhao | |

OTHER PUBLICATIONS

"Holding Wings on Model Airplanes" and "Uses for Neodymium Magnets," K&J Magnetics, Inc., printed from www.kjmagnetics.com/uses.asp (Aug. 5, 2009).

"Fokker Dr.1 Triplane, ½ Scale Parkflyer," dV Flight Technologies (Apr. 6, 2005).

* cited by examiner

*Primary Examiner* — Gene Kim
*Assistant Examiner* — Urszula M Cegielnik
(74) *Attorney, Agent, or Firm* — Drinker Biddle & Reath LLP

(57) ABSTRACT

A model airplane may include a fuselage, a wing rib removably attached at a top portion of the fuselage, and a wing having two wing sections. Each of the two wing sections may include an opening at an exterior end. The model airplane may also include a connecting member removably coupled with the fuselage alternatively either at the wing rib or at a side portion of the fuselage. The connecting member may be removably inserted into the opening of a wing section to couple the wing section with the fuselage. The connecting member may include a ferromagnetic material which is magnetically attracted to a ferromagnetic material included at an end of the opening within the wing section when the connecting member is inserted into the opening to couple the wing section with the fuselage.

15 Claims, 7 Drawing Sheets

METHOD AND APPARATUS FOR WING MOUNTING FOR A MODEL AIRPLANE

FIELD OF THE INVENTION

This invention pertains to assembly components for a model aircraft and, more particularly, to a method and apparatus for wing mounting for a model airplane.

BACKGROUND OF THE INVENTION

When building a model of any kind, it is important to make sure that all of the various pieces of the model are aligned and securely attached to one another. This is important not only for aesthetic reasons but also to allow an operating model to function properly. One of the most important sections to assemble with respect to a model airplane is the wing section. This is because the wing section generates lift and includes the flight control surfaces known as the ailerons.

In order for an aircraft to fly, the wings must generate lift. Lift results from the camber in the wing causing the air passing over the top of the wing to travel a greater distance than the air traveling along the underside of the wing. Because the air on the top of the wing must travel a greater distance, the air must accelerate and flow faster than the air on the bottom of the wing. The accelerated airflow on the top of the wing results in less pressure on the top of the wing than on the bottom, thereby generating lift.

Depending on where the wings are mounted, a model airplane may have different maneuvering characteristics. When the wings are mounted relatively low on the sides of or under the fuselage, the aircraft may fly faster, be more maneuverable and sensitive to adjustments in the flight controls. However, with such a wing configuration the aircraft may also require more skill to avoid losing control. When the wings are mounted on the top of the fuselage, the aircraft may fly slower, be less maneuverable and less sensitive to adjustments in the flight controls. With such a relatively high mounted wing configuration, the aircraft may require less skill to avoid losing control. Thus, aircraft with wings mounted low on the fuselage may be more desirable to experienced model airplane pilots, while aircraft with wings mounted on top may be more desirable to novice model airplane pilots.

Model airplanes may come in many sizes from small to large. Typically, model airplanes are transported by automobile from a home to an area in which they may be flown. Larger airplanes may be difficult to load and unload from the automobile because of their large wingspans. While many model airplanes have removable wings, typically the wing sections are made of one complete, unitary piece that is secured to the fuselage. In order to facilitate transporting, particularly since model airplane wings may be relatively fragile, it may be desirable to have wings that may be disassembled into two sections, and which may be quickly and precisely mounted to the fuselage.

BRIEF SUMMARY OF THE INVENTION

The invention relates to a model airplane, and more particularly, to a method and apparatus for wing mounting for a model airplane.

An exemplary apparatus for coupling a wing with a fuselage of a model airplane may include a connecting member which may be coupled with the fuselage of the model airplane and which may have a first end removably inserted within an opening within the wing. A first ferromagnetic material may be disposed at the first end of the connecting member. A second ferromagnetic material may be disposed at an end of the opening within the wing. The first ferromagnetic material and the second ferromagnetic material may be magnetically attracted to one another.

An exemplary wing assembly for a model airplane may include a wing which may be removably coupled with a side wing attachment region of a fuselage of a model airplane. The wing assembly may also include a wing rib disposed at a top portion of the fuselage. The wing rib may include an upper wing attachment region with which the wing may be removably coupled when the wing is decoupled from the side wing attachment region of the fuselage of the model airplane. The wing rib may be removably disposed at the top portion of the fuselage such that the wing rib is removed when the wing is coupled with the fuselage at the side wing attachment region.

An exemplary model airplane may comprise a fuselage, a wing rib attached at a top portion of the fuselage, and a wing section having an opening within. The opening may be at an exterior end of the wing section, and a ferromagnetic material may be at an end of the opening within the wing section. The model airplane may also comprise a connecting member which is removably coupled with the fuselage alternatively either at the wing rib or at a side portion of the fuselage. The connecting member may include a ferromagnetic material which is magnetically attracted to the ferromagnetic material of the end of the opening within the wing section when the connecting member is removably inserted into the opening to couple the wing section with the fuselage.

DETAILED DESCRIPTION OF THE INVENTION

Figure 1:
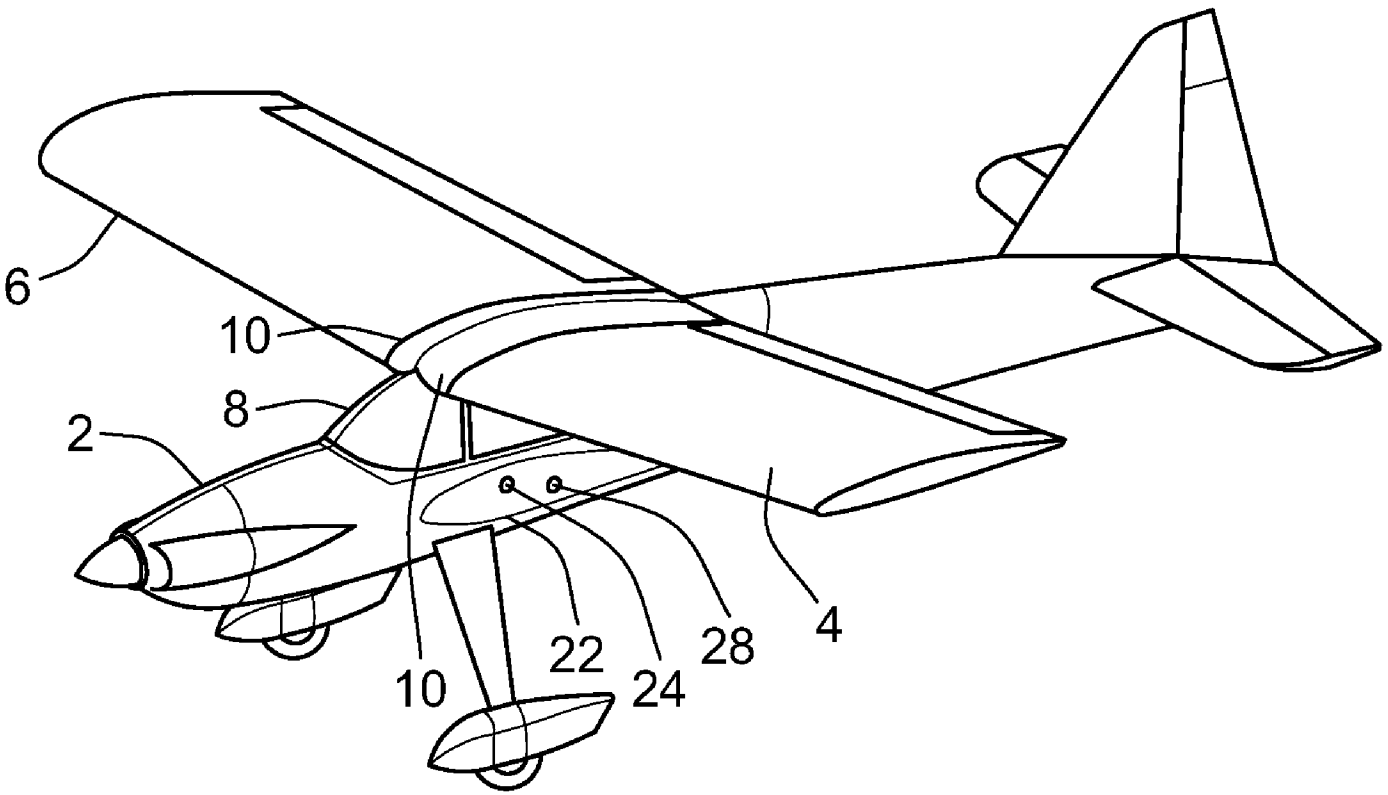
FIG. 1 is an exemplary perspective view showing an exemplary model airplane having a wing mounted in an upper position.

FIG. 1 is an exemplary perspective view showing an exemplary model airplane having a wing mounted in an upper position. By having the wing mounted in the upper position, the model airplane may be more stable and less likely to lose control. Thus, the upper mounting position for the wing is well-suite for novice model airplane pilots. The exemplary model airplane includes a fuselage 2. The wing includes a left wing section 4 and a right wing section 6. The left wing section 4 and the right wing section 6 may be coupled with the fuselage 2 via a wing-supporting canopy structure 8. The wing supporting canopy structure 8 may be removably coupled with or attached to the fuselage 2. As such, the fuselage 2 may alternatively be coupled with a plurality of different canopy structures. The wing-supporting canopy structure 8 may include a wing rib 10 configured to be coupled with the wing. The wing rib 10 may be configured to couple with the left wing section 4 on one side and to couple with the right wing section 6 on an opposite side.

Figure 2:
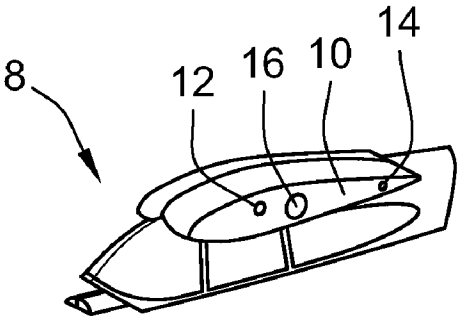
FIG. 2 is a perspective view showing an exemplary wing-supporting canopy structure of the model airplane of FIG. 1

FIG. 2 is a perspective view showing an exemplary wing-supporting canopy structure 8 of the model airplane of FIG. 1. The wing-supporting canopy structure 8 may be removably coupled with the fuselage 2 of the model airplane of FIG. 1. In particular, the model airplane may have an opening in a cockpit region which is configured to accept and secure a canopy structure. Accordingly, a variety of different canopy structures having different configurations and features may be installed on the model airplane. The wing-supporting canopy structure 8 may include the wing rib 10. The wing rib 10 may effectively provide an extension of the wing sections 4 and 6 to the center of the top of the wing-supporting canopy structure 8. The wing rib 10 may include a connecting member sleeve 12 by which a connecting member 18 (described elsewhere herein) may be coupled with the wing-supporting canopy structure 8, and in turn, the fuselage 2 of the model airplane. The connecting member sleeve 12 may be open on both sides of the wing rib 10 and the wing-supporting canopy structure 8.

The wing rib 10 may include an upper wing attachment region including a wing-attachment surface at which the wing section 4 may attach. A corresponding wing-attachment surface may also be disposed on the opposite side of the wing rib 10 of the wing-supporting canopy structure 8. The wing-attachment surface may be substantially vertically oriented and shaped to fit to the curvature of the corresponding surface of the wing section, e.g., by essentially matching the curvature of the fuselage 2 at a side wing attachment region 22. Accordingly, a single set of wing sections 4 and 6 may couple with the fuselage 2 of the model airplane at either the upper wing attachment region of the wing rib 10 or the side wing attachment region 22 of the fuselage 2.

In some embodiments, the wing rib 10 may include a fuselage-attachment surface at a bottom portion of the wing rib 10 which couples with the fuselage 2. In other embodiments, the wing rib 10 may include a fuselage-attachment surface at a bottom portion of the wing rib 10 which couples with the wing supporting canopy structure 8, which in turn couples with the fuselage 2. The wing rib 10's fuselage-attachment surface may be substantially perpendicular to the wing-attachment surface of the wing rib 10.

The wing rib 10 may also include a wing locator pin hole 14. A wing locator pin 20 may be received by the wing locator pin hole 14 on one end and the wing section 4 or 6 on an opposite end, and thereby provide additional security and stability for the attachment of the wing section 4 or 6 to the wing rib 10. In some embodiments, the wing locator pin hole 14 may only be open to a depth within the wing rib 10 which is less than a total width of the wing rib 10. In these embodiments, the wing section 4 may couple with the wing rib 10 using one wing locator pin 20, and the wing section 6 may couple with the wing rib 10 using another wing locator pin 20. In other embodiments, the wing locator pin hole 14 may be open from one side of the wing rib 10 to the other side of the wing rib 10, and thereby provide a passage through which a single wing locator pin 20 may couple with both the left wing section 4 and the right wing section 6 through the wing locator pin hole 14.

The wing rib 10 may also include an optional passage 16 through which control cables, wires, tubes, or other materials as may be desired may pass between the wing-supporting canopy structure 8 and the wing section 4 or 6. The optional passage 16 may provide a passage between the wing sections 4 and 6 and the fuselage 2.

Figure 3:
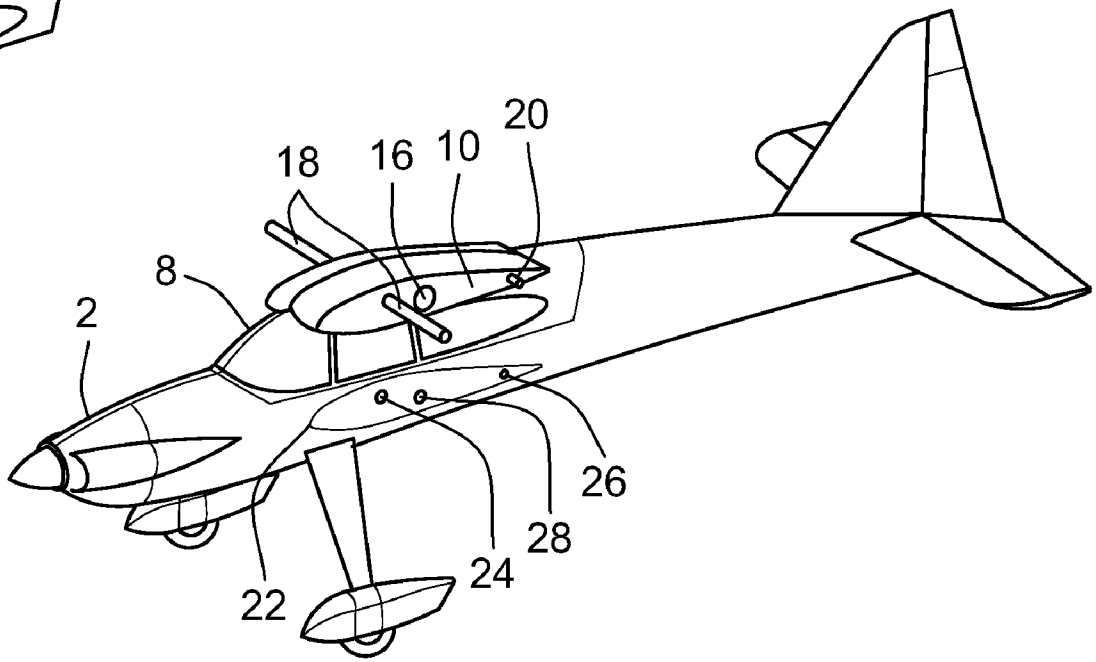
FIG. 3 is a perspective view showing the exemplary model airplane of FIG. 1 with the wing sections detached.

FIG. 3 is a perspective view showing the exemplary model airplane of FIG. 1 with the wing sections detached. A connecting member 18 may pass through the connecting member sleeve 12 of the wing rib 10. The connecting member sleeve 12 may optionally be omitted and an opening within the wing rib 10 may function to receive the connecting member 18 without using a sleeve. In some embodiments, a single connecting member 18 may pass all the way through the wing rib 10 of the wing-supporting canopy structure 8 and connect to both the wing section 4 and the wing section 6. In other embodiments, one connecting member 18 may connect the wing section 4 to the wing rib 10 on the left side of the wing-supporting canopy structure 8, and another connecting member 18 may connect the wing section 6 to the wing rib 10 on the right side of the wing-supporting canopy structure 8.

While the connecting member 18 is illustrated as being round like a shaft or a rod, in some embodiments, the connecting member 18 may take other shapes, such as rectangular, square, pentagonal, hexagonal, octagonal, etc. In some embodiments, the connecting member 18 may have a hollow portion, but in other embodiments, the connecting member 18 may include a solid material. The connecting member 18 may include a ferromagnetic material such as iron or ferrite. In some embodiments, the connecting member 18 may include primarily a non-ferromagnetic material such as plastic, fiberglass, wood, or aluminum. To reduce overall weight of the aircraft, the connecting member 18 may be constructed of a lightweight material in such a way as to effectively minimize weight while maintaining required structural integrity and strength.

The fuselage 2 may also include the side wing attachment region 22 on either side. The side wing attachment region 22 may be configured such that the left wing section 4 may be coupled with the fuselage 2 at the side wing attachment region 22 in a similar manner and with a similar effectiveness as the left wing section 4 may be coupled with the wing rib 10. The side wing attachment region 22 may include a connecting member sleeve 24 which corresponds to the structure and function of the connecting member sleeve 12 of the wing rib 10. The connecting member sleeve 24 may optionally be omitted and an opening within the fuselage 2 may function to receive the connecting member 18 without using a sleeve. The side wing attachment region 22 may also include an optional passage 28 which corresponds to the structure and function of the optional passage 16 of the wing rib 10. The side wing attachment region 22 may further include a wing locator pin hole 26 which corresponds to the structure and function of the wing locator pin hole 14 of the wing rib 10. Accordingly, the wing section 4 may alternatively be removably coupled with the fuselage 2 of the model airplane either at the wing rib 10 or at the side wing attachment region 22.

To facilitate the alternative attachment of the wing section 4 to the wing rib 10 or the side wing attachment region 22, an end of the wing section 4 which attaches to the fuselage 2 may have a surface profile which substantially corresponds to a surface profile of the side wing attachment region 22, and the side surface of an upper wing attachment region of the wing rib 10 may have a surface profile substantially matching the surface profile of the side wing attachment region 22. Accordingly, the side wing attachment region 22 of the fuselage 2 may be smooth when the wing sections 4 and 6 are removed therefrom and attached via the wing rib 10. The wing rib 10 and/or the wing-supporting canopy structure 8 may be removed from the fuselage 2 of the model airplane when the wing (i.e., wing sections 4 and 6) is coupled with the side wing attachment region 22 of the fuselage 2. Thus, the connecting member 18 may be coupled with the fuselage 2 of the model airplane either via the side wing attachment region 22 of the fuselage 2 or the wing rib 10 of the wing-supporting canopy structure 8 which in turn may be coupled with the fuselage 2. In this way, a single model airplane having a single set of wing sections 4 and 6 may be easily alternatively configured for high maneuverability in a side wing configuration for experienced pilots or for high stability in an upper wing configuration for novice pilots.

Figure 4:
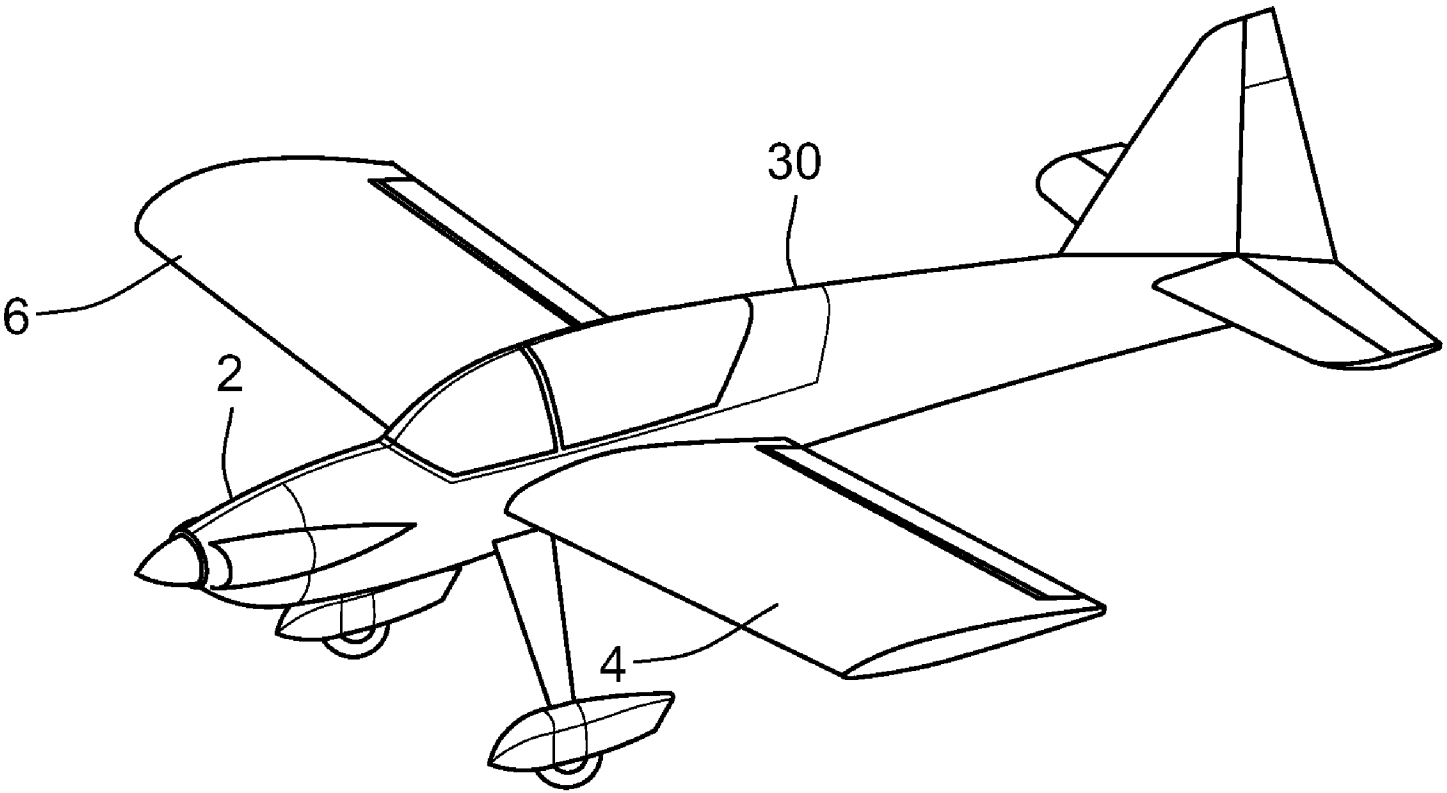
FIG. 4 is a perspective view showing an exemplary model airplane having wing sections mounted in a side wing position.

FIG. 4 is a perspective view showing an exemplary model airplane having wing sections mounted in a side wing position. The exemplary model airplane illustrated in FIG. 4 is similar to that illustrated in FIG. 1, except that the wing sections 4 and 6 are mounted in a side wing position alongside the fuselage 2, and an alternative canopy structure 30 is installed on the fuselage 2 in place of the removable wing-supporting canopy structure 8 illustrated in FIGS. 1 and 2. The wing-supporting canopy structure 8 is decoupled from the fuselage 2 when the alternative canopy structure 30 is coupled with the fuselage 2. The alternative canopy structure 30 may not include a wing rib 10 or upper wing attachment region, because the wing sections 4 and 6 may be mounted at the side wing attachment regions 22 as illustrated in FIG. 3 on the fuselage 2 below the alternative canopy structure 30. By having the wing mounted in the side wing position, the model airplane may be more maneuverable. Thus, the side wing mounting position is well-suite for experienced model airplane pilots who wish the model airplane to be more responsive and maneuverable and can skillfully maintain control of the model airplane.

Figures 5, 6:
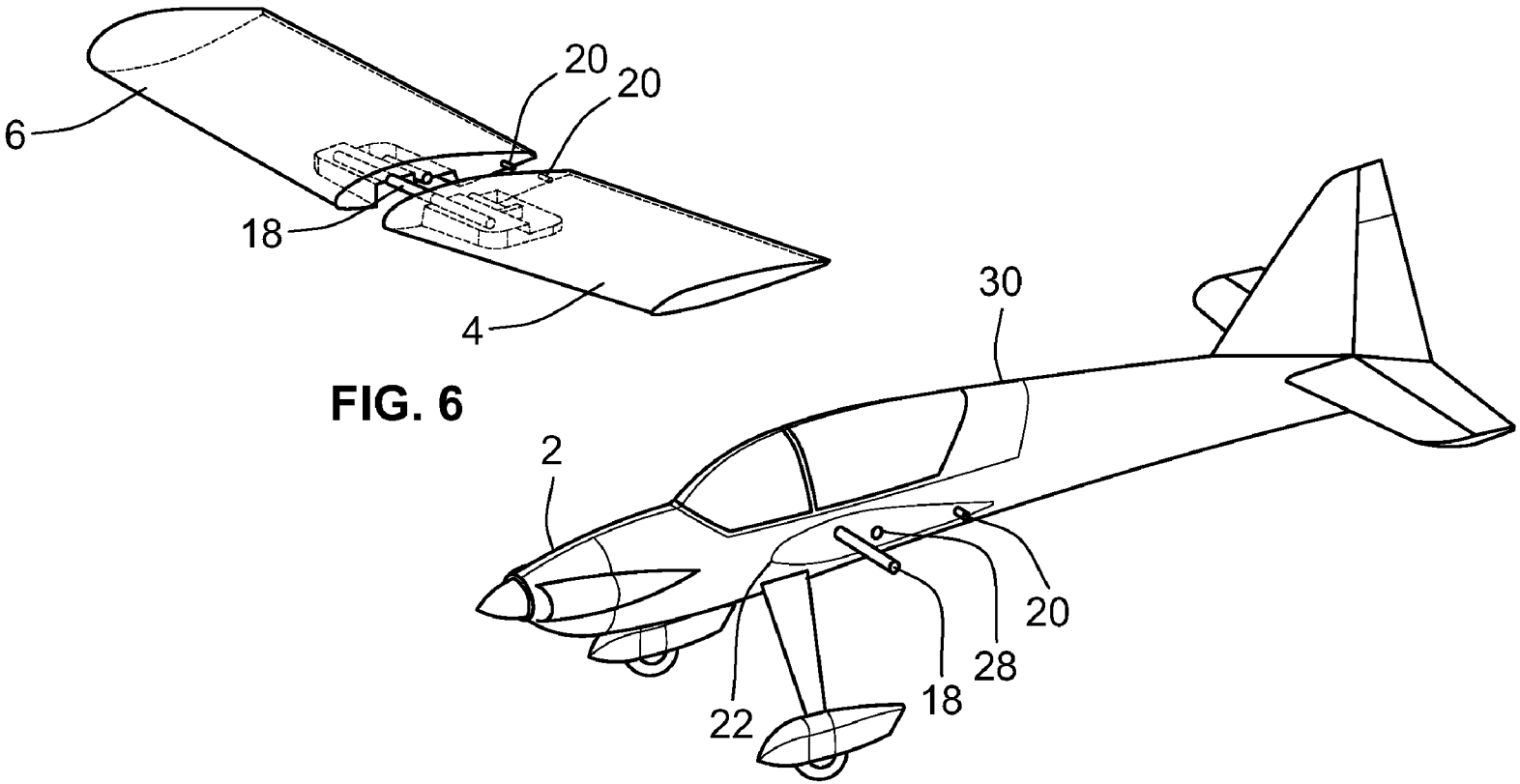
FIG. 5 is a perspective view showing the exemplary model airplane of FIG. 4 with the wing sections detached.
FIG. 6 is a perspective view showing exemplary wing sections which may be attached to the fuselage of FIGS. 1 and 4.

FIG. 5 is a perspective view showing the exemplary model airplane of FIG. 4 with the wing sections detached. As illustrated in FIG. 5, the connecting member 18 may be inserted in the side wing attachment region 22 to provide support for connecting the wing sections 4 and 6 to the fuselage 2. The connecting member 18 may pass through an opening in the fuselage 2 via the connecting member sleeve 24 and couple with both the wing section 4 and the wing section 6. Additionally, the wing locator pin 20 may be inserted in the wing locator pin hole 26 (illustrated in FIG. 3).

FIG. 6 is a perspective view showing exemplary wing sections which may be attached to the fuselage 2 of FIGS. 1 and 4. As illustrated, the connecting member 18 may couple with both the wing section 4 and the wing section 6. When the wing sections 4 and 6 are mounted in an upper wing position as illustrated in FIG. 1, the connecting member 18 may pass through an opening of the wing rib 10 as illustrated in FIG. 3 and the wing locator pins 20 may couple with the wing locator pin holes 14 of the wing rib 10 as illustrated in FIG. 2 to couple the wing sections 4 and 6 with the fuselage 2 of the model airplane. When the wing sections 4 and 6 are mounted in a side wing position as illustrated in FIG. 4, the connecting member 18 and the wing locator pins 20 may couple with the fuselage 2 at the side wing attachment region 22 as illustrated in FIG. 5 to couple the wing sections 4 and 6 to the fuselage 2 of the model airplane. The connecting member 18 may coupled with the connecting member sleeve 24 and the wing locator pins 20 may couple with the wing locator pin holes 26 of the side wing attachment region 22 as illustrated in FIG. 3.

Figure 7:
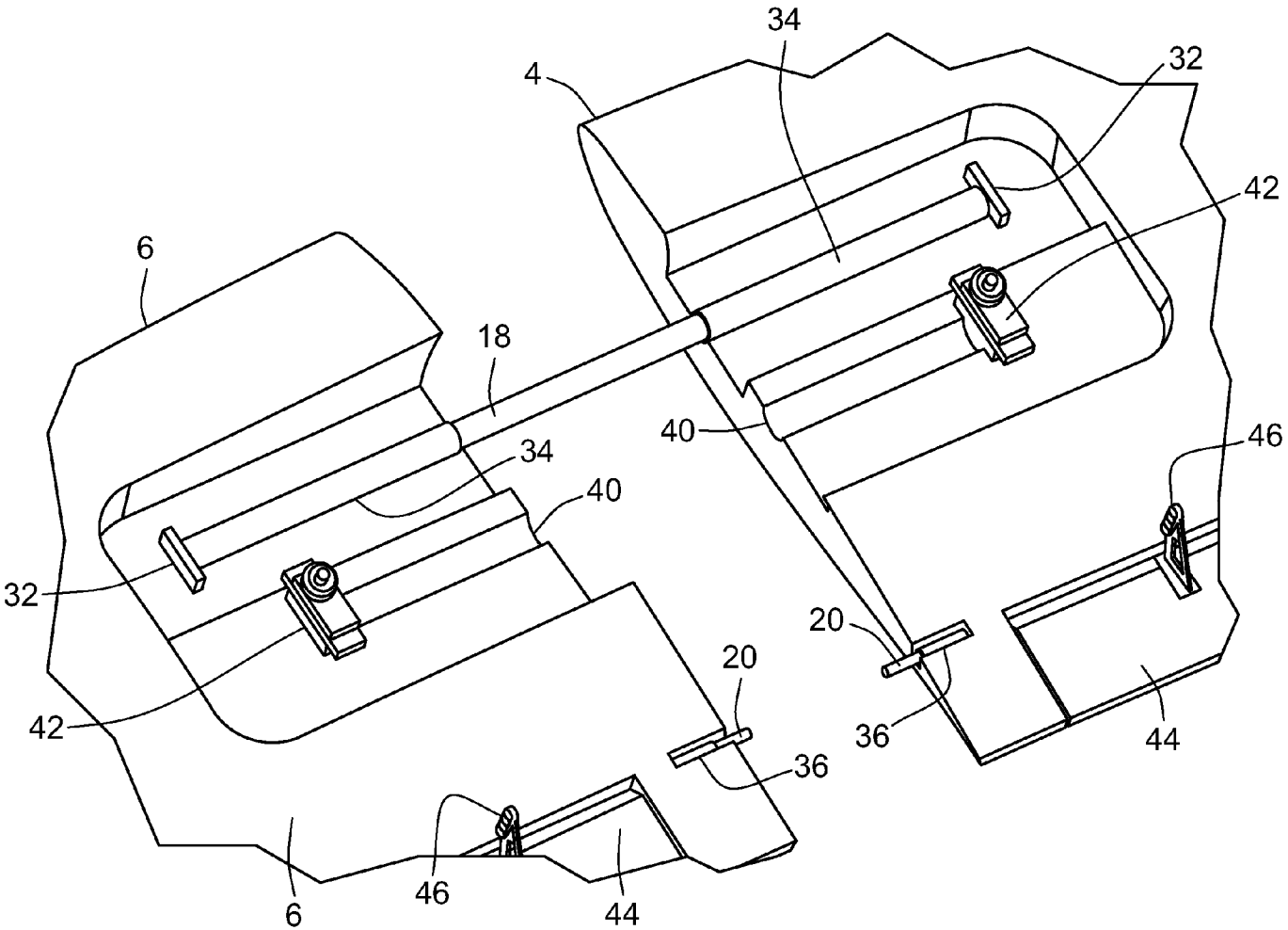
FIG. 7 is a perspective view showing an underside of the exemplary wing sections of FIG. 6 including a connecting member.

FIG. 7 is a perspective view showing an underside of the exemplary wing sections 4 and 6 of FIG. 6 including the connecting member 18. The wing sections 4 and 6 may collectively comprise a wing. For clarity, only a portion of the wing sections 4 and 6 are illustrated in FIG. 7. Portions of the wing sections 4 and 6 are shown as being cut away on the bottom thereof to better illustrate interior features of the wing sections 4 and 6. However, embodiments of the wing sections 4 and 6 may include smooth and solid bottom surfaces.

Each of the wing sections 4 and 6 may have a first end which may be removably coupled with a side surface of the side wing attachment region 22 of the fuselage 2 (see, e.g., FIG. 5). The first end may include openings into which the connecting member 18 may be inserted. The wing section 4 may be removably coupled with a first side surface on one side of the fuselage 2 while the wing section 6 may be removably coupled with a second side surface on an opposite side of the fuselage 2. The wing sections 4 and 6 may alternatively be removably coupled with respective side surfaces of upper wing attachment regions of the wing rib 10 (see, e.g., FIG. 3) when the wing sections 4 and 6 are decoupled from the side wing attachment regions 22 of the fuselage 2.

The connecting member 18 may be removably inserted into connecting member sleeves 34 of the wing sections 4 and 6. The connecting member sleeves 34 may each have a hollow interior with an open end at the first end of the respective wing section which couples with the fuselage 2 of the model airplane. The connecting member sleeves 34 may also each have a second end within the respective wing section. In some embodiments, the wing sections 4 and 6 may not include connecting member sleeves 34. In these embodiments, the openings in which the connecting member sleeves 34 are shown as being installed may receive the connecting member 18 without using the connecting member sleeves 34. A ferromagnetic material 32 may be disposed at the second end of each of the connecting member sleeves 34 of the wing sections 4 and 6. When the connecting member 18 includes a ferromagnetic material at an end which reaches close proximity to the ferromagnetic material 32 within the wing section, the connecting member 18 may be held in place in the wing section by magnetic attraction between the ferromagnetic material of the connecting member 18 (e.g., ferromagnetic material 38 as shown in FIG. 8) and the ferromagnetic material 32 within the wing section.

The wing locator pins 20 may couple with the wing sections 4 and 6 at wing locator pin sleeves 36. In some embodiments, the wing sections 4 and 6 may not include wing locator pin sleeves 36, but may receive the wing locator pins 20 using pin locator holes that do not include sleeves. While the wing locator pins 20 are illustrated as being round, in some embodiments, the wing locator pins 20 may take other shapes, such as rectangular, pentagonal, hexagonal, octagonal, etc. In some embodiments the wing locator pins 20 may have a hollow portion, but in other embodiments, the wing locator pins 20 may include a solid material. The wing locator pins 20 may include primarily a non-ferromagnetic material. In some embodiments, the wing locator pins 20 may include a ferromagnetic material similar to that of the connecting member 18.

As illustrated, the wing sections 4 and 6 may include optional flight control components such as aileron control servos 42. The aileron control servos 42 may control respective aileron controls 46 to move ailerons 44 up and down. The ailerons 44 may control whether the model airplane changes its roll angle in flight. Wires for controlling the optional flight control components may pass from each of the wing sections 4 and 6 into the fuselage 2 via a wing center hole 40. The wing center hole 40 may be disposed proximate the center hole 16 when the wing sections 4 and 6 are installed in an upper wing position as illustrated in FIG. 1, such that wires for controlling the flight control components may pass from the wing center hole 40 into the center hole 16. Alternatively, the wing center hole 40 may be disposed proximate the center hole 28 when the wing sections 4 and 6 are installed in a side wing position as illustrated in FIG. 4, such that wires for controlling the flight control components may pass from the wing center hole 40 into the center hole 28. The wires for controlling the flight control components may then pass into the fuselage 2.

Figure 8:
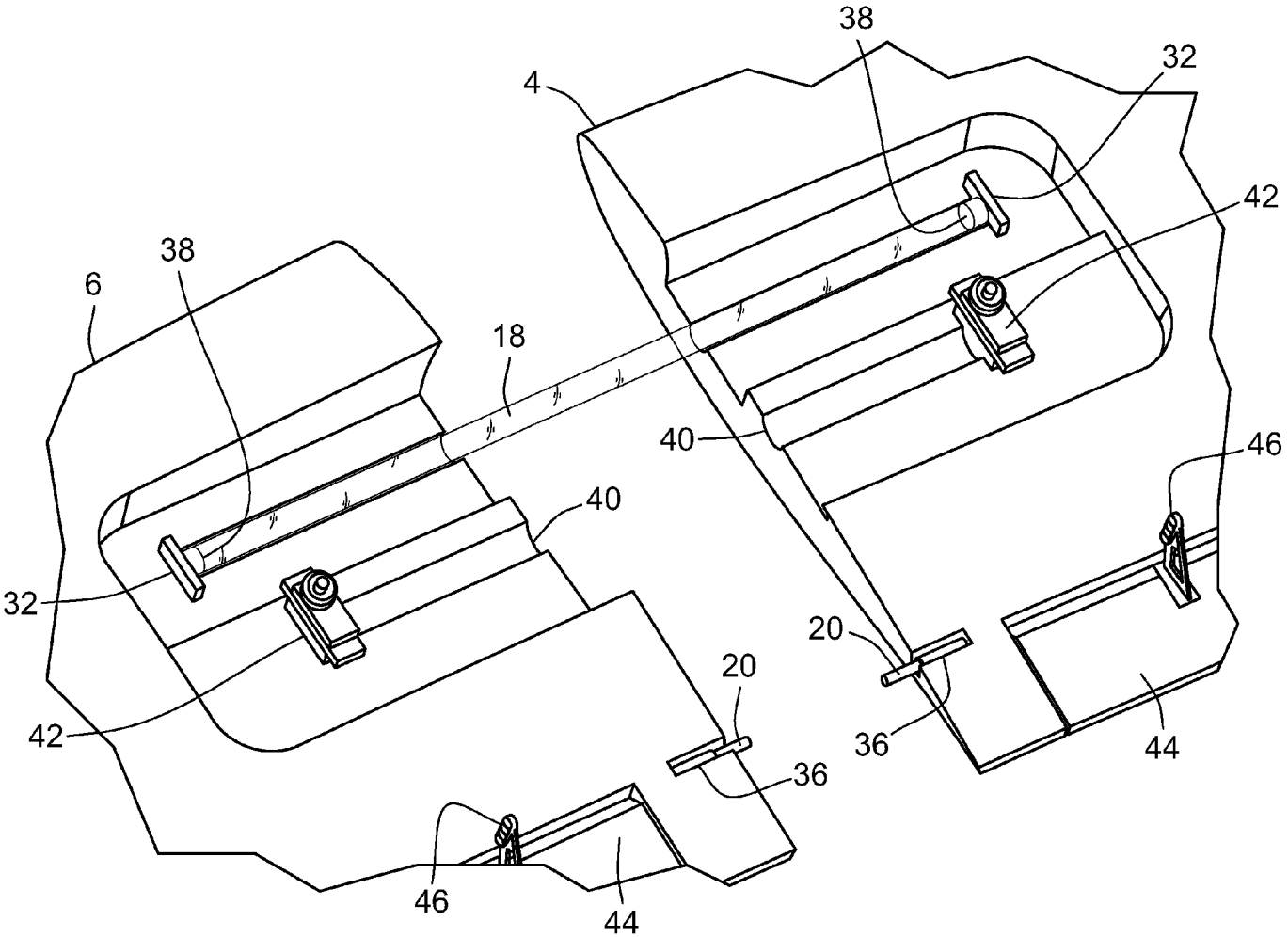
FIG. 8 is a perspective view showing the underside of the exemplary wing sections of FIG. 6 with the connecting member shown as being transparent.

FIG. 8 is a perspective view showing the underside of the exemplary wing sections of FIG. 6 with the connecting member 18 shown as being transparent. In various embodiments, ferromagnetic material 38 may be included at the ends of the connecting member 18. In these embodiments, the ferromagnetic material 38 may be disposed proximate the ferromagnetic material 32 of the wing sections 4 and 6 when the connecting member 18 is coupled with the wing sections 4 and 6. The ferromagnetic material 38 may include a magnet which provides an attractive force when disposed proximate the ferromagnetic material 32. In alternative embodiments, the ferromagnetic material 32 may include a magnet which provides an attractive force when disposed proximate the ferromagnetic material 38. The ferromagnetic material 38 may be integral with the connecting member 18. In some embodiments, the connecting member 18 may include hollow portions at either end, and the ferromagnetic material 38 may be inserted into an opening at each end of the connecting member 18. When the ferromagnetic material 38 is within the connecting member 18 and the ferromagnetic material 32 is within the wing sections 4 and 6, magnets and wing attachment mechanisms may not be visible on the visible portions of the model airplane including the wing sections 4 and 6. Accordingly, the model airplane may be more aerodynamic and aesthetically pleasing. The use of ferromagnetic materials 32 and 38 in conjunction with the connecting member 18 may make attaching and detaching the wing sections 4 and 6 from the fuselage 2 quick, easy, and reliable without damaging the wing sections or the fuselage 2. Accordingly, the wing sections 4 and 6 may be quickly and easily removed for transport of the model airplane while the wing sections 4 and 6 may be quickly and easily well-fitted to the fuselage 2 for secure aerodynamic performance while in flight.

Figure 9:
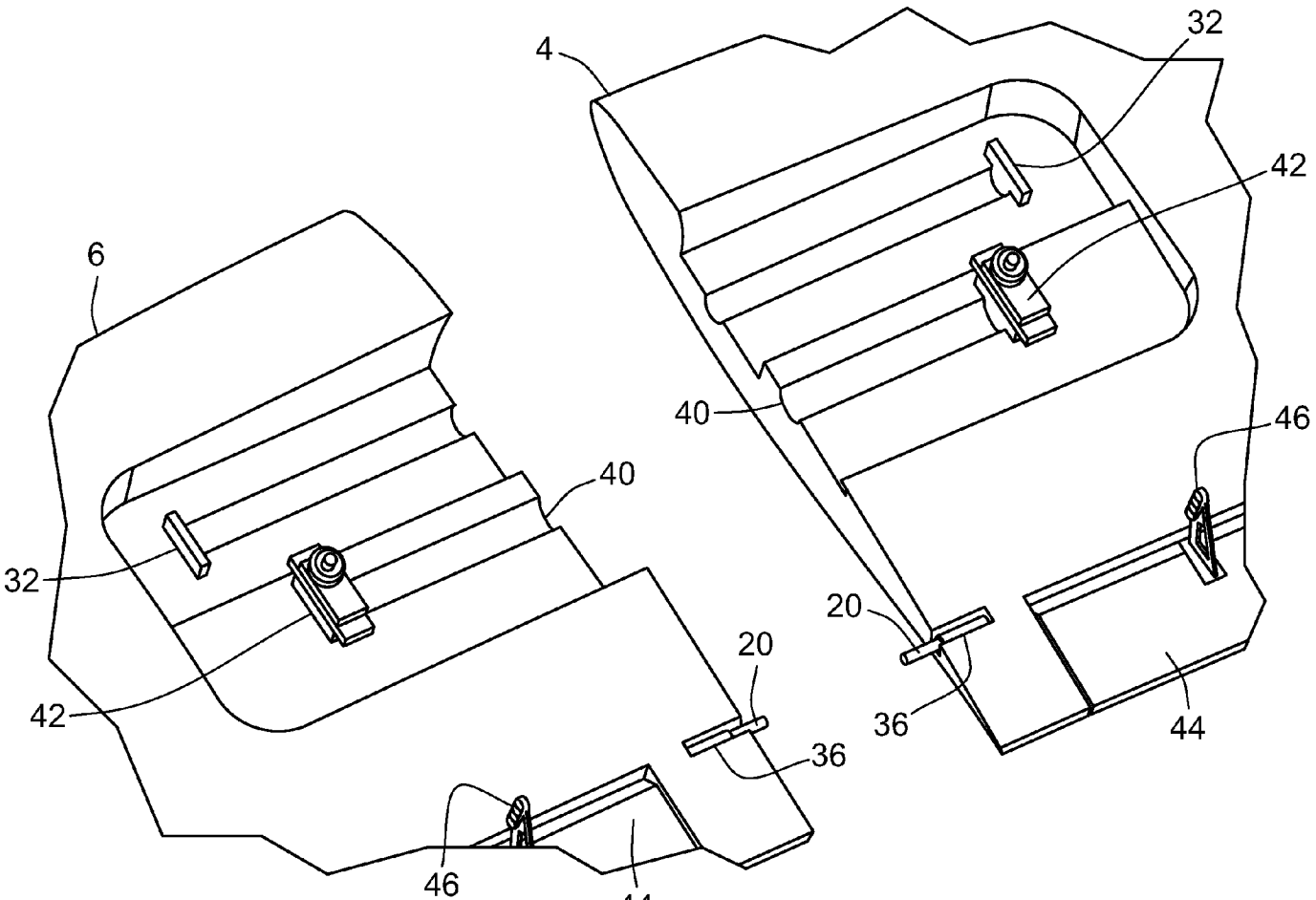
FIG. 9 is a perspective view showing the underside of the exemplary wing sections of FIG. 6 with the connecting member removed.

FIG. 9 is a perspective view showing the underside of the exemplary wing sections of FIG. 6 with the connecting member 18 removed. As illustrated, the connecting member 18 and the ferromagnetic material 32 coupled therewith may be removed from each of the wing sections 4 and 6. In some embodiments, the wing locator pins 20 may also be removed from each of the wing sections 4 and 6. When a force parallel to the connecting member 18 is exerted on the wing sections 4 and 6, and the force exerted exceeds the attractive force between the ferromagnetic material 32 and the ferromagnetic material 38, the wing sections 4 and 6 may separate from the connecting member 18 and consequently from the fuselage 2 to which the wing sections 4 and 6 may be attached. The force may include a force exerted by a pilots hands when intentionally removing the wing sections 4 and 6 from the fuselage 2. In this case, the magnetic coupling of the wing sections 4 and 6 to the model airplane using the connecting member 18 may facilitate quick and easy reconfiguration of the model airplane into a high wing configuration as illustrated in FIG. 1 or a side wing configuration as illustrated in FIG. 4.

As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

It will be recognized that the terms "comprising," "including," and "having," as used herein, are specifically intended to be read as open-ended terms of art. The use of the terms "a," "an," "the" and similar referents in the context of describing the invention (especially in the context of the following claims) are to be construed to cover both the singular and the plural, unless otherwise indicated herein or clearly contradicted by context. The use of any and all examples or exemplary language (e.g., "such as") provided herein is intended merely to better illuminate the invention and does not pose a limitation on the scope of the invention unless otherwise claimed. No language in the specification should be construed as indicating any nonclaimed element as essential to the practice of the invention.

What is claimed is:

1. A wing assembly for a model airplane, the wing assembly comprising:

first and second wing segments removably coupleable to respective side wing attachment regions of a fuselage of the model airplane;

a wing rib removably disposable at a top portion of the fuselage, the wing rib including upper wing attachment regions to which respective ones of the wing segments may be removably and alternatively coupled when the wing segments are decoupled from the side wing attachment regions of the fuselage;

wherein the wing rib is attached to an upper portion of a wing supporting canopy structure removably coupleable to the fuselage of the model airplane; and an alternative canopy structure lacking a wing rib, the alternative canopy structure being coupleable to the fuselage when the wing supporting canopy structure is decoupled from the fuselage and the wing segments are coupled to the side wing attachment regions of the fuselage.

2. The wing assembly of claim 1, wherein the wing rib is removably coupleable to the fuselage such that the wing rib is decoupleable from the fuselage when the wing segments are coupled to the side wing attachment regions of the fuselage.

3. A wing assembly for a model airplane, the wing assembly comprising:

first and second wing segments removably coupleable to respective side wing attachment regions of a fuselage of the model airplane;

a wing rib removably disposable at a top portion of the fuselage, the wing rib including upper wing attachment regions to which respective ones of the wing segments may be removably and alternatively coupled when the wing segments are decoupled from the side wing attachment regions of the fuselage;

a first end of the first wing segment has a first surface profile substantially corresponding to a second surface profile of a first of the side wing attachment regions; and a first of the upper wing attachment regions of the wing rib has a third surface profile substantially matching the second surface profile.

4. The wing assembly of claim 3, wherein the first wing segment includes an opening having an open end at the first end of the first wing segment and a hollow interior, and the wing assembly further comprises a connecting member having a first end removably insertable into the opening of the first wing segment, the connecting member being coupleable to the fuselage of the model airplane.

5. The wing assembly of claim 4, wherein the connecting member is alternatively removably coupleable to the fuselage at the first of the side wing attachment regions and the first of the upper wing attachment regions.

6. A wing assembly for a model airplane, the wing assembly comprising:

first and second wing segments removably coupleable to respective side wing attachment regions of a fuselage of the model airplane;

a wing rib removably disposable at a top portion of the fuselage, the wing rib including upper wing attachment regions to which respective ones of the wing segments may be removably and alternatively coupled when the wing segments are decoupled from the side wing attachment regions of the fuselage;

a connecting member having a first end removably insertable into an opening of the first wing segment, the connecting member removably coupleable to the fuselage;

wherein the connecting member has a second end removably insertable into a second opening of the second wing segment, the connecting member removably passable through the fuselage;

a first ferromagnetic material disposed at the first end of the connecting member;

a second ferromagnetic material disposed within the first wing segment at an interior end of the opening;

wherein the first ferromagnetic material and the second ferromagnetic material are magnetically attracted to one another;

a third ferromagnetic material disposed at the second end of the connecting member; and a fourth ferromagnetic material disposed within the second wing segment at an interior end of the second opening;

wherein the third ferromagnetic material and the fourth ferromagnetic material are magnetically attracted to one another.

7. The wing assembly of claim 6, further comprising:

a first canopy including the wing rib, the first canopy being removably attacheable to the fuselage for use in alternatively coupling the wing segments to the wing rib; and a second canopy removably attacheable to the fuselage when the wing segments are coupled to the side wing attachment regions.

8. A model airplane comprising:

first and second wing segments;

a fuselage having first and second side wing attachment regions on opposite sides of the fuselage;

a wing support canopy including a wing rib having first and second upper wing attachment regions on opposite sides of the wing rib, the wing support canopy selectively attacheable to the fuselage; and an alternative canopy lacking a wing rib, the alternative canopy selectively attacheable to the fuselage, wherein the wing segments may be selectively coupled to respective ones of the side wing attachment regions and to respective ones of the upper wing attachment regions, and the alternative canopy may be coupled to the fuselage instead of the wing support canopy when the wing segments are coupled to the side wing attachment regions.

9. The model airplane of claim 8, wherein a first end of the first wing segment has a first surface profile substantially corresponding to a second surface profile of the first side wing attachment region, and the first upper wing attachment region has a third surface profile substantially matching the second surface profile.

10. The model airplane of claim 9, wherein the first wing segment includes an opening having an open end at the first end of the first wing segment and a hollow interior, and the model airplane further comprises a connecting member having a first end insertable into the opening of the first wing segment, the connecting member being coupleable to the fuselage of the model airplane.

11. The model airplane of claim 8, further comprising:

a connecting member having a first end insertable into an opening of the first wing segment, the connecting member being coupled to the fuselage of the model airplane;

a first ferromagnetic material disposed at the first end of the connecting member; and a second ferromagnetic material disposed within the first wing segment at an interior end of the opening;

wherein the first ferromagnetic material and the second ferromagnetic material are magnetically attracted to one another.

12. A model airplane fuselage comprising:

first and second side wing attachment regions on opposite sides of the fuselage;

a wing support canopy including a wing rib having first and second upper wing attachment regions on opposite sides of the wing rib, the wing support canopy selectively attacheable to the fuselage; and an alternative canopy lacking a wing rib, the alternative canopy attacheable to the fuselage, wherein first and second wing segments may be selectively coupled to respective ones of the side wing attachment regions and to respective ones of the upper wing attachment regions, and the alternative canopy may be coupled to the fuselage instead of the wing support canopy when the wing segments are coupled to the side wing attachment regions.

13. The model airplane fuselage of claim 12, wherein the first side wing attachment region has a first surface profile substantially corresponding to a second surface profile of an end of the first wing segment, and the first upper wing attachment region has a third surface profile substantially matching the first surface profile.

14. The model airplane fuselage of claim 12, further comprising:

a connecting member having a first end insertable into a first opening of the first wing segment and a second end insertable into a second opening of the second wing segment;

a first sleeve passing through the fuselage between the first and second side wing attachment regions;

a second sleeve passing through the wing rib between the first and second upper wing attachment regions, the connecting member being insertable through the first and second sleeves.

15. The model airplane fuselage of claim 14, wherein the connecting member has a first ferromagnetic material disposed at the first end, the first ferromagnetic material magnetically attracted to a second ferromagnetic material disposed within the first wing segment at an interior end of the first opening.

* * * * *